United States Patent [19]

Klomp

[11] 4,018,193

[45] Apr. 19, 1977

[54] VORTEX CHAMBER STRATIFIED CHARGE ENGINE

[75] Inventor: Edward D. Klomp, Mount Clemens, Mich.

[73] Assignee: General Motors Corporation, Detroit, Mich.

[22] Filed: Feb. 10, 1975

[21] Appl. No.: 548,683

[52] U.S. Cl. ..... 123/30 C; 123/32 ST; 123/75 B; 123/DIG. 4

[51] Int. Cl.[2] ..... F02B 3/00

[58] Field of Search ..... 123/32 ST, 75 B, 127, 123/30 C, 30 D, 32 SP, DIG. 4

[56] References Cited

UNITED STATES PATENTS

| | | | |
|---|---|---|---|
| 3,174,470 | 3/1965 | Von Seggern et al. | 123/75 B |
| 3,270,721 | 9/1966 | Hideg et al. | 123/32 ST |
| 3,283,751 | 11/1966 | Goossah et al. | 123/32 ST |
| 3,304,922 | 2/1967 | Hideg | 123/32 ST |
| 3,331,361 | 7/1967 | Baudry | 123/75 B |
| 3,364,911 | 1/1968 | Baudry et al. | 123/127 |
| 3,418,981 | 12/1968 | Von Seggern et al. | 123/30 C |
| 3,678,905 | 7/1972 | Diehl | 123/75 B |

*Primary Examiner*—C. J. Husar
*Assistant Examiner*—David D. Reynolds
*Attorney, Agent, or Firm*—Robert J. Outland

[57] ABSTRACT

An internal combustion engine is provided with means for creating a vortical stratified charge in a preferably axisymmetric combustion chamber which may be conical in shape. Excessive mixing of rich and lean mixtures, which make up the stratified charge, is avoided by first admitting a homogeneous lean mixture on the intake stroke through a swirl port to develop a vortical motion and subsequently admitting a rich air-fuel mixture toward the end of the intake stroke directed so as to form a swirling pattern of rich mixture around the spark plug. Means are provided for directing and timing the admission of lean and rich mixtures.

3 Claims, 3 Drawing Figures

VORTEX CHAMBER STRATIFIED CHARGE ENGINE

BACKGROUND OF THE INVENTION

This invention relates to internal combustion engines and more particularly to engines in which stratified charges of segregated rich and lean air-fuel mixtures are formed in the engine combustion chambers.

It is known in the art to provide internal combustion engines with means for forming segregated or stratified mixtures of different mixture strengths within an open combustion chamber. Some success in forming mixtures of this type has been obtained by using direct injection of atomized liquid fuel into a swirling mass of air adjacent to, or upstream of, the spark plug location.

To avoid the problems of direct fuel injection, other proposals have been made to utilize separate or divided inlet passages to direct the rich and lean mixtures to different portions of the engine combustion chamber. I have found, however, that where development of a swirling stratified charge is attempted by simultaneous admission of rich and lean mixtures through separate or divided passages, the resistance to flow of residual gases in the cylinder causes a partial mixing of the rich and lean mixtures before a suitable vortex or swirling flow pattern has been generated, thus reducing the degree in which stratified charge combustion is realized.

SUMMARY OF THE INVENTION

My invention overcomes the problems of excessive mixing of discreet charges in the cylinder by providing means to first introduce, through a swirl type inlet port, a homogeneous lean air-fuel mixture which enters the cylinder and develops a vortical or swirl patterned flow therein. Subsequently, near the end of the piston stroke, a charge of rich mixture is directed into the cylinder through a separate intake passage. The rich mixture charge is also directed in a vortical or swirling motion and toward a small portion of the combustion chamber surrounding the spark plug which is preferably centrally located on the cylinder and/or combustion chamber axis. The direction of swirl is the same as and its angular velocity is preferably approximately equal to that developed in the main charge of lean air-fuel mixture so that turbulence at the interface between the discreet charges is minimized and excessive mixing is avoided.

The invention further includes means for practicing the above disclosed method which will be more fully understood from the following description of a preferred embodiment taken together with the accompanying drawing.

DESCRIPTION OF THE PREFERRED EMBODIMENT

Figure 1:
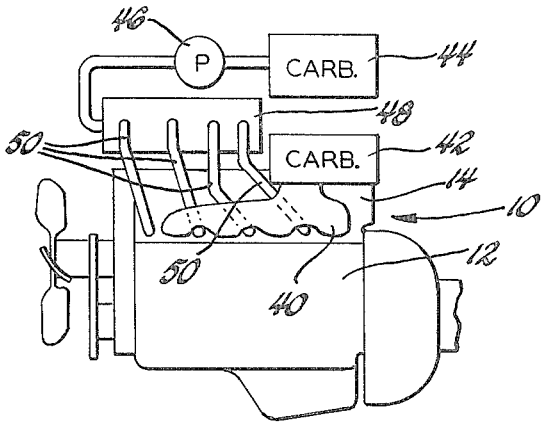
FIG. 1 is a side elevational view, partially diagrammatic in nature, showing a multi-cylinder internal combustion engine equipped with vortex combustion chambers and stratified charge producing means according to the invention.
Figure 2:
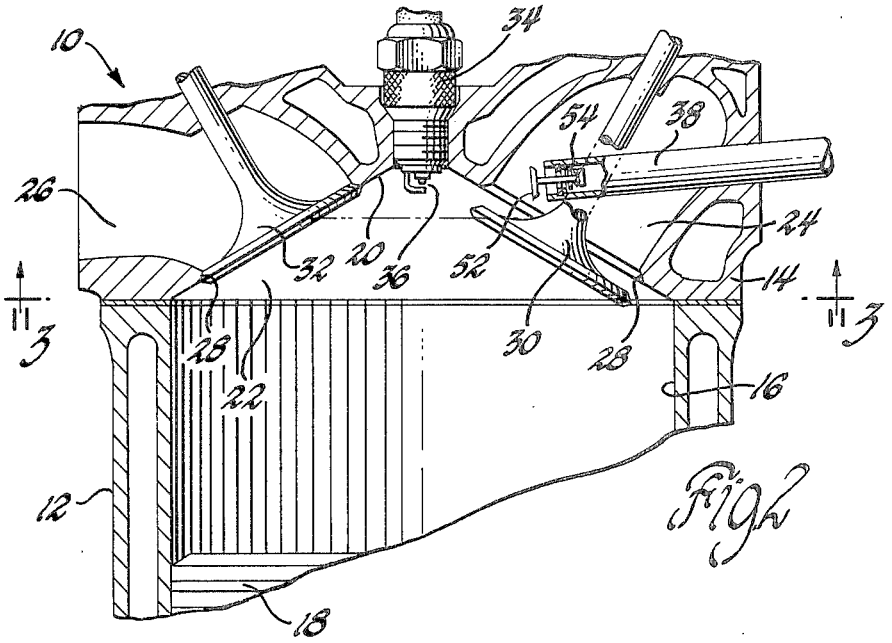
FIG. 2 is a fragmentary transverse cross-sectional view through one of the cylinders of the engine of FIG. 1 showing the cylinder and cylinder head structure.

Referring now to the drawing in detail, numeral 10 generally indicates an internal combustion engine of the four-stroke cycle type and having a cylinder block 12 on which is mounted a cylinder head 14. The cylinder block internally defines a plurality of spaced cylinders 16, only one being shown. Each cylinder receives a piston 18 reciprocably movable therein and connected in conventional manner with a crankshaft, now shown, for delivery of power thereto.

The cylinder head 14 includes a plurality of generally conical recesses 20, one of which is axially aligned with each of the cylinders forming a conical end wall that closes the end of its respective cylinder and defines with the piston and cylinder a variable volume combustion chamber 22.

The cylinder head further defines inlet and exhaust ports 24, 26, one for each cylinder, which terminate at generally opposite positions of the conically recessed end wall 20 in valve seats 28. Communication of the inlet and exhaust ports 24, 26 with the combustion chamber 22 is controlled by inlet and exhaust valves 30, 32 reciprocably carried in the cylinder head and engageable with the valve seats 28 of their respective ports. The intake and exhaust valves are connected through conventional valve actuating means, not shown, to operate in timed relation with the piston of their respective cylinder so as to sequentially perform the usual intake, compression, expansion and exhaust strokes of the four-stroke cycle.

A spark plug 34 is mounted at each cylinder location in the cylinder head at the apex of the conical end wall 20, with its spark gap 36 centered on the axis of the cylinder and combustion chamber, between the intake and exhaust valves. Also at each cylinder location, an auxiliary intake tube 38 extends through the wall of the cylinder head into the main intake port, defining an auxiliary inlet port that terminates near the main intake port opening.

Figure 3:
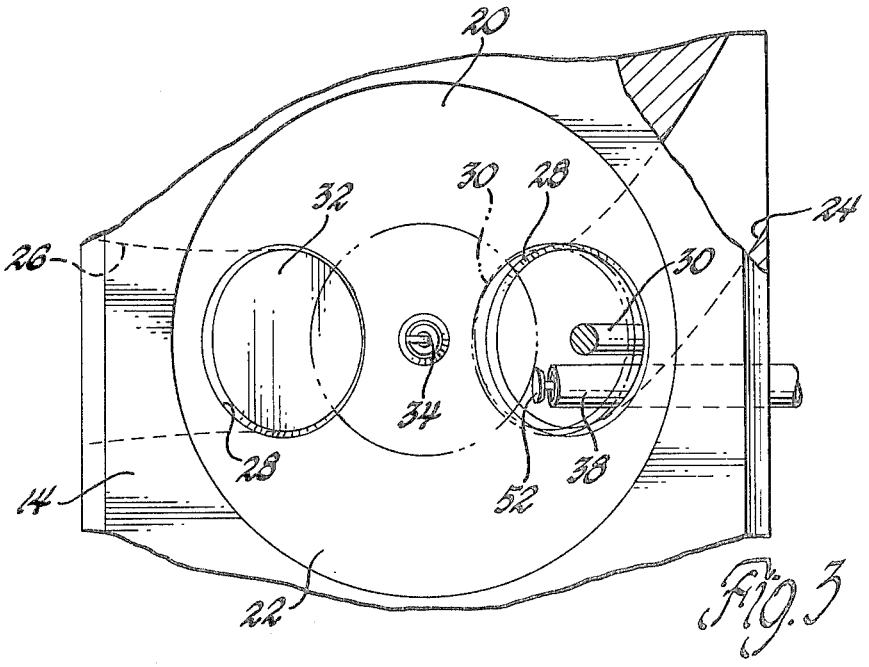
FIG. 3 is a view of one engine combustion chamber as seen from the plane indicated by the line 3—3 of FIG. 2.

As is best shown in FIG. 3, the main inlet port 24 for each cylinder is angularly positioned with respect to the cylinder radius passing therethrough so that it causes the intake fluid passing through the port to enter the cylinder and develop a vortical or swirling motion in the combustion chamber with a clockwise swirl direction as shown in the figure. The port 24 thus is of the type sometimes called a swirl port. The auxiliary inlet port formed by tube 38 is positioned within main inlet port 24 so that the intake fluids passing through the auxiliary port are directed through the upper edge of the main port and slightly to the left of center from the axis, as seen in FIG. 3, to form a swirling mass at the end of the conical combustion chamber and around the spark plug 36. The orientations of the main and auxiliary inlet passages or port is such that both masses of inlet fluids passing through the ports are caused to swirl in the same clockwise direction and preferably at about the same angular velocity so that mixing between the masses is minimized.

Externally of the cylinder head there is mounted a conventional intake manifold 40 which connects with the inlet ports 24 of the cylinder head and which is fed by a carburetor 42 with a homogeneous air-fuel mixture normally controlled to be leaner than a stoichiometric mixture. This air-fuel mixture thus forms the main mass of combustible fluids delivered to the various cylinders by their respective main inlet ports 24.

The engine also includes an auxiliary carburetor 44 which supplies a rich air-fuel mixture to a pump 46, which may be engine driven to slightly pressurize the mixture and in turn supply it to suitable distribution means such as rotary valve 48. The rotary valve 48 connects through individual conduits 50 with the auxiliary inlet tubes 38 of the respective cylinders. At the end of each auxiliary inlet tube 38 there is preferably mounted a check or one way valve, such as poppet valve 52, which is biased in a closing direction by a spring 54.

The operation of the engine as described is as follows. Rotation of the crankshaft causes reciprocation of the pistons in the various cylinders and correlative actuation of the valves to perform the previously mentioned fourstroke cycle, means being provided to actuate the spark plug for ignition of the charge near the end of the compression stroke in conventional fashion. The timing of the valves is such that the main inlet valve opens near, and preferably slightly in advance of, the piston top dead center position which marks the beginning of the downward intake stroke.

The intake valve then continues its opening and closing movements, remaining open during substantially the complete downward stroke of the piston and preferably until slightly after the piston reaches the bottom dead center position. During this period, the downward stroke of the piston creates a reduced pressure or vacuum in the cylinder, which draws a charge of lean air-fuel mixture into the cylinder through the main inlet port 24. The orientation of the port causes this charge to be directed in a vortical or swirling motion around the axis of the cylinder in a manner known in the art.

After the piston has moved downwardly at least half way on its intake stroke, and preferably near the end of the stroke, the vortical motion of the charge within the cylinder has become well developed. It is at this point that the introduction of an auxiliary rich air-fuel mixture charge is timed to take place. This timing is accomplished by the rotary valve 48 which is driven in timed relation with the engine and operates at the desired moment to connect the inlet tube 38 with the pressurized mixture delivered by the pump 46. The pressure of the mixture opens the check valve 52 and forces a controlled amount of rich air-fuel mixture out through the end of the auxiliary inlet tube, past the open main inlet valve and into a swirling pattern at the apex of the combustion chamber adjacent the spark plug. The flow of rich auxiliary mixture is cut off in advance of closing of the main inlet valve 30 so as to avoid mixing the rich and lean mixtures within the main inlet port. When the rotary valve shuts off the flow to a particular cylinder, the check valve 52 is closed by its spring and thus prevents inter-mixing of the rich and lean mixtures.

Upon closing of the inlet valve, the piston moves upwardly on its compression stroke, compressing the stratified rich and lean mixtures which have preferably been directed into vortical flows of like angular velocity so that mixing of the stratified charges is substantially avoided or minimized. Thus, the rich mixture remains in a swirling pattern at the end of the chamber around the spark plug, while the lean charge swirls in the remainder of the cylinder. When the piston nears top dead center, a spark at the plug gap 36 ignites the rich mixture, which quickly burns, causing a flame front large enough to ignite the lean mixture adjacent thereto and complete the combustion of combustibles in the cylinder while the piston moves downwardly on the expansion stroke. Subsequently, as the piston moves upwardly, the exhaust valve 32 opens, permitting the exhaust of burned gases from the cylinder.

It may be seen that the arrangement and method of the invention combine to provide a swirling stratified charge within an engine cylinder in which mixing between the two charges is minimized by establishing the vortical or swirling flow in the main charge of lean mixture before the igniting charge of rich auxiliary mixture is introduced. The disclosure further specifies a preferred embodiment for accomplishing the desired method of operation, but it should be recognized that numerous variations in the design of the components disclosed could be made without departing from the inventive concepts involved in this disclosure. Accordingly, it is intended that the invention not be limited to the specific form disclosed, but that it be given the scope permitted by the language of the following claims.

What is claimed is:

1. The combination in a four-stroke cycle internal combustion engine of means defining a closed end cylinder a piston reciprocable in said cylinder and defining therewith a variable volume combustion chamber at said cylinder closed end main inlet and exhaust ports connecting with said cylinder at said closed end inlet and exhaust valves respectively associated with said ports and operable to close and open their connections with said cylinder, said inlet port and its associated inlet valve being arranged to direct incoming air in a swirling motion around the axis of said cylinder, said inlet valve being connected for operation in timed relation with said piston to be open during substantially the entire piston intake stroke, means to supply a lean air-fuel mixture to said inlet port for admission to said cylinder during said intake stroke for formation of a swirling charge in said combustion chamber, spark ignition means in said cylinder and centered on the closed end thereof.

an auxiliary inlet port, substantially smaller than said main inlet port and connecting with said cylinder, means to supply a rich air-fuel mixture to said auxiliary inlet port, and means controlling the admission of said rich mixture to said cylinder from said auxiliary inlet port, said controlling means being operative in timed relation with said piston to permit such admission of rich mixture during only the latter portion of the piston intake stroke, said auxiliary intake port and controlling means being arranged to direct said rich mixture into a swirling pattern at said cylinder end around said spark ignition means, said swirling pattern having the same rotational direction as and remaining relatively undisturbed by the adjacent mass of swirling lean mixture by virture of the swirling motion of the lean mixture being established prior to the admission of the rich mixture to said cylinder.

2. A four-stroke cycle internal combustion engine comprising at least one cylinder a piston reciprocable in each said cylinder a conical end wall closing the end of each said cylinder and defining with each said piston and cylinder a variable volume combustion chamber, spark ignition means in each said combustion chamber at the apex of said conical end wall, main inlet and exhaust ports connecting with each said combustion chamber at spaced locations of said conical end wall, each said main inlet port being angled to direct inlet fluid in a swirling motion around the axis of said combustion chamber, poppet inlet and exhaust valves for each cylinder, operable to close and open the connections of said inlet and exhaust ports respectively with their respective combustion chamber, each said inlet valve being operative in timed relation with said piston to open its main inlet port during substantially the entire intake stroke of its respective piston, an auxiliary inlet port for each cylinder terminating in said main inlet port adjacent said inlet valve, each said auxiliary inlet port being oriented to direct incoming fluid through the end of its respective main inlet port into a portion of the associated combustion chamber near its conical wall apex in a swirling pattern having the same rotational direction as the swirling motion of said main inlet fluid, first means to provide a lean air-fuel mixture to said main inlet ports, second means to provide a rich air-fuel mixture to said auxiliary inlet ports, and means controlling the transmission of said rich mixture from said auxiliary inlet ports to said combustion chambers, said controlling means being operative in timed relation with the respective pistons to permit such transmission only during the latter portion of the respective piston intake stroke, whereby said swirling pattern of rich mixture is established around each said spark ignition means after the development of a substantial body of swirling lean mixture in the respective combustion chamber and excessive turbulence and mixing of the stratified masses of swirling rich and lean mixtures is thereby avoided.

3. The combination of claim 2 wherein said controlling means comprises a pump between said second means and said auxiliary inlet ports to pressurize the rich mixture, a timing and distributing valve between the pump and the auxiliary inlet ports to time the flow through said auxiliary ports with the movements of their respective pistons, and a check valve in each of said auxiliary ports and arranged to prevent reverse flow therethrough so as to avoid mixing of the rich and lean mixtures in the associated main and auxiliary ports during nonflow periods in each cycle.

* * * * *